US007708157B2

(12) United States Patent
Kemper

(10) Patent No.: US 7,708,157 B2
(45) Date of Patent: May 4, 2010

(54) AUTOMATIC CENTRAL BUFFER COUPLING

(75) Inventor: Andreas Kemper, Lengede (DE)

(73) Assignee: Voith Patent GmbH, Heidenheim (DE)

( * ) Notice: Subject to any disclaimer, the term of this patent is extended or adjusted under 35 U.S.C. 154(b) by 112 days.

(21) Appl. No.: 12/000,132

(22) Filed: Dec. 10, 2007

(65) Prior Publication Data

US 2008/0277366 A1 Nov. 13, 2008

(30) Foreign Application Priority Data

Feb. 8, 2007 (EP) ..... 07002766

(51) Int. Cl.
*B61G 9/04* (2006.01)

(52) U.S. Cl. ..... 213/9; 213/7; 213/57; 213/75 R

(58) Field of Classification Search ..... 213/7, 213/9, 12, 18, 20, 57, 75 R
See application file for complete search history.

(56) References Cited

U.S. PATENT DOCUMENTS 6,279,765 B1 * 8/2001 Monaco ..... 213/22
7,513,376 B2 * 4/2009 Sprave ..... 213/75 R

FOREIGN PATENT DOCUMENTS

| | | |
|---|---|---|
| DE | 19719646 | 11/1998 |
| EP | 0608531 | 8/1994 |
| EP | 0736440 | 10/1996 |

* cited by examiner

*Primary Examiner*—S. Joseph Morano
*Assistant Examiner*—Zachary Kuhfuss
(74) *Attorney, Agent, or Firm*—Jean C. Edwards, Esq.; Akerman Senterfitt

(57) ABSTRACT

The invention relates to an automatic central buffer coupling having a coupling head, a coupling rod and a shock absorber including a destructively-configured force-absorbing member in the form of a deformable tube. The invention provides additional functionality of extendability and retractability to the coupling rod, the and for the central buffer coupling to include a controllable linear drive for the axial displacement of the coupling rod relative the fixing plate and for the bearing block to include a first bearing block component against which adjoins the coupling head-side end of the deformable tube, and a second bearing block component to which the vehicle-side end of the coupling rod is articulated, whereby the second bearing block component is axially displaceable relative the first bearing block component by means of the linear drive.

14 Claims, 5 Drawing Sheets

AUTOMATIC CENTRAL BUFFER COUPLING

CROSS-REFERENCE TO RELATED APPLICATIONS

The present invention claims priority from European Patent Application No. 07002766.9, filed Feb. 8, 2007, the contents of which are herein incorporated by reference in their entirety.

BACKGROUND OF THE INVENTION

1. Field of the Invention

The present invention relates to an automatic central buffer coupling for a vehicle, a rail-mounted vehicle in particular, including a coupling head, a coupling rod connected to the coupling head, a bearing block to which the vehicle-side end of the coupling rod is articulated so as to be horizontally pivotable, a fixing plate preferably attachable to the underframe of the vehicle to secure the central buffer coupling to the vehicle, and a shock absorber having a destructively-configured force-absorbing member in the form of a deformable tube with its coupling head-side end against the bearing block and its vehicle-side end against the fixing plate, whereby the shock absorber includes a bolted connection which axially braces the bearing block, the deformable tube and the fixing plate, and upon excessive impact, i.e., upon a predefinable operating load for the central buffer coupling being exceeded, permits an axial displacement of the bearing block relative the fixing plate.

2. Description of the Related Art

Existing central buffer couplings, in particular in the field of railway technology, serve to transfer tensile and compressive forces impacting a car body of a first vehicle from the car body to a neighboring second vehicle when the central buffer coupling is coupled to a central buffer coupling of the second vehicle.

In order to ensure cushioning of the tensile and compressive forces occurring during normal vehicle operation, and transferred, for example, in the case of a multi-member vehicle, between the individual car bodies during the normal vehicle operation by the central buffer coupling, a normally regeneratively-configured drawgear is customarily provided in the coupling rod and/or in the bearing provided to articulate the coupling rod to the bearing block. The drawgear is usually designed to accommodate tensile and compressive forces up to a defined magnitude and relay any forces exceeding that to the vehicle underframe.

Thus, while tensile and compressive forces which occur during normal vehicle operation are cushioned by the drawgear, once the operating load of the drawgear is exceeded, however, for instance, upon the vehicle colliding with an obstacle or upon the vehicle abruptly decelerating, there is the risk that the normally regeneratively-configured drawgear and conceivably also the coupling link between the individual car bodies, the interface between the individual car bodies respectively, will be destroyed or damaged. In any case, the drawgear is inadequate to absorb the whole of the resultant force. Hence, the drawgear is then not integrated into the force-absorbing concept of the vehicle as a whole such that the resulting impact force is transferred directly to the vehicle underframe. Doing so subjects the same to extreme loads and may possibly damage or even destroy the same. With multi-member rail vehicles in such cases, there is the risk of car body derailment.

Frequently used with the objective of protecting the vehicle underframe against damage from strong rear-end impacts, is a shock absorber including a destructively-configured force-absorbing member, for example, in the form of a deformable tube, whereby the force-absorbing member of this shock absorber is designed so as to be activated when the operational absorption of the drawgear is exhausted, and will absorb and thus, dissipate at least a portion of the force transferred through the force-absorbing member in the force flow. In the case of a shock absorber including a destructively-configured force-absorbing member in the form of a deformable tube, the deformable tube is plastically deformed in a defined and destructive manner such that the resulting impact force is at least partly converted into deformation work and heat.

Thus, the problem relates to an automatic central buffer coupling of the type cited above, i.e., including a shock absorber having a destructively-configured force-absorbing member, which frequently needs to have the additional functionality of the central buffer coupling being displaceable in the axial direction, i.e., in the longitudinal direction of the vehicle, between a first extended position, in which the coupling head of the central buffer coupling is in the coupling plane of the vehicle and thus, ready to be coupled, and a second retracted position in which the coupling head is in a position rearward of the coupling plane close to the vehicle.

This additional functionality can, for example, be necessary when the central buffer coupling is utilized in a high-speed train. This type of train is characterized by its end car frequently being built according to optimized aerodynamic observations in terms of the vehicle dynamics. Specifically, the nose cone of such a vehicle, the end car respectively, is frequently manufactured in accordance with aerodynamic specifications, with the objective of reducing cross-wind sensitivity, bow wave and so-called sonic booms.

A preferably glass-fiber reinforced nose cone is usually utilized in order to accommodate the aerodynamic requirements, the nose cone including, for example, a pneumatically-openable front hatch, whereby the automatic central buffer coupling with the shock absorber as well as the actuating mechanism for the front hatch and further components such as for instance signal lights and air ducts for climate control are disposed in the nose cone. The shell of the nose cone itself, made from reinforced glass fiber, for example, is often supported on a supporting structure which itself is in turn bolted to the car body structure. This supporting structure can also serve as the fixing base for the e.g., pneumatically-operating actuating mechanism of the front hatch or a front lifeguard pilot (if provided).

So that two such end cars configured according to the aerodynamic concept can be coupled/uncoupled as quickly as possible, the profiling to the nose cone calls for a coupling concept which ensures a specific axial distance for the extendable automatic central buffer coupling in conjunction with the e.g. pneumatically-actuated front hatch. The distance to be provided is—contingent upon the design of the nose cone—usually in a range of from approximately 100 mm to 400 mm.

Necessary to give an automatic central buffer coupling of the type specified at the outset the additional functionality of axial extendability is, for example, a linear drive, with which the central buffer coupling, the coupling arm of the central buffer coupling respectively, can be axially displaced along with the coupling head relative the vehicle underframe or relative the fixing plate serving to secure the central buffer coupling to the vehicle respectively. Since the mounting space in the vehicle nose cone for the automatic central buffer coupling is often limited, however, the linear drive provided to axially displace the central buffer coupling so as to realize the additional desired functionality of axial extendability and retractability for the central buffer coupling needs to be realized in as compact and space-saving a manner as possible.

Based on this problem, it is necessary to find an automatic central buffer coupling of the type cited at the outset which exhibits the additional functionality of axial extendability and retractability without the need to increase the space in the vehicle nose cone needed to mount the central buffer coupling.

SUMMARY OF THE INVENTION

This task is solved by an automatic central buffer coupling of the type cited at the outset in that the central buffer coupling firstly includes a controllable linear drive for the axial displacement of the coupling arm relative the fixing plate and, secondly, the bearing block includes a first bearing block component against which adjoins the coupling head-side end of the deformable tube and a second bearing block component to which the vehicle-side end of the coupling rod is articulated, whereby the second bearing block component is axially displaceable relative the first bearing block component by means of the linear drive.

The present invention is characterized by the fact that extending and retracting the coupling rod does not necessitate axially displacing the entire central buffer coupling inclusive of the shock absorber relative to the fixing plate. Instead, according to the invention, only the second bearing block component, to which the vehicle-side end of the coupling rod is articulated, is moved relative the fixing plate. The first bearing block component, against which adjoins the coupling head-side end of the deformable tube, and which together with the deformable tube and the fixing plate axially fixes the shock absorber by means of the bolted connection, is fixed relative the fixing plate during the axial displacement of the second bearing block component, the coupling arm respectively, as effected by the linear drive.

Sectioning the bearing block into a first bearing block component which remains stationary upon the axial displacement of the coupling rod actuated by the linear drive and a second bearing block component which is movable relative the first bearing block component upon the axial displacement of the coupling rod actuated by the linear drive makes additional space unnecessary in the vehicle nose cone for the automatic central buffer coupling exhibiting the additional functionality of coupling rod extendability and retractability. Accordingly, the system-contingent mounting space for the automatic central buffer coupling in the nose cone, the front end of the vehicle (end car) respectively, remains unchanged, even though the automatic central buffer coupling is provided with the additional functionality of axial displacement of the coupling rod.

The automatic central buffer coupling according to the present invention in particular, takes the aerodynamic requirements of the nose cone into account in allowing for the most optimum crash behavior possible without requiring any reengineering of the car body structure or the nose cone design.

In one embodiment, the (controllable) linear drive provided for the axial displacement of the coupling arm relative to the fixing plate, provides for the linear drive to include a primary part coupled with the first bearing block component and a secondary part coupled with the second bearing block component, whereby upon actuation of the linear drive, the primary part and the secondary part of the linear drive are movable relative to one another in a telescopic sequence of motion in which the primary part and the secondary part of the linear drive axially displace into one another. Thus, with the axial displacement of the first bearing block component relative to the second bearing block component actuated by the linear drive, both bearing block components are likewise moved in a telescopic sequence of motion, whereby the second bearing block component is axially displaced within the stationary first bearing block component upon the axial displacement effected by the linear drive. The telescopic movement of the two bearing block components to one another allows for the necessary path of displacement for the axial extending and retracting of the coupling rod.

As regards the axial displacement of the first bearing block component relative to the second bearing block component effected by the linear drive, it is preferably provided for the first bearing block component to include a bearing plate in which an opening is provided through which the coupling head-side end of the second bearing block component is at least partly guided upon an axial displacement of the second bearing block component effected by the linear drive. This opening provided in the bearing plate of the first bearing block component, thus, exhibits a diameter and/or a profile which is larger than the maximum cross-sectional profile on that area of the second bearing block component which is guided through the opening upon the axial displacement effected by the linear drive.

With reference to the automatic central buffer coupling, in the present invention, while the bearing block includes a first and a second bearing block component which are axially displaceable relative to one another by means of the linear drive, when the operating load of the central buffer coupling is exceeded, for instance upon an excessive impact, the entire bearing block including the first and the second bearing block component, is axially displaced toward the fixing plate as allowed by the bolted connection of the shock absorber, thus, is axially displaced in the direction of the vehicle.

In the latter embodiment in which the first bearing block component includes a bearing plate, the bearing plate serves to axially fix the bearing block via the first bearing block component on which the bearing plate is provided, the deformable tube and the fixing plate, via the bolted connection of the shock absorber.

In the latter embodiment in which the first bearing block component includes a bearing plate provided for the central buffer coupling to further include a preferably releasable support plate on the coupling head-side end face of the bearing plate for securing a center reset mechanism and/or a vertical support for the coupling rod. Of course, other components used for the coupling rod operation can also be provided on the support plate. Because these components (center reset mechanism, vertical support, etc.) are fixed to the bearing plate of the first bearing block component via the support plate, these components remain stationary relative to the first bearing block component upon the linear drive-actuated axial displacement of the first bearing block component to which the vehicle-side end of the coupling rod is articulated such that the axially-movable coupling rod moves relative to these components on the first bearing block component by means of the linear drive.

In order that the relative movement between the coupling rod and the components necessary for the coupling rod's operation is executed as frictionlessly and wear-resistantly as possible, a guide sleeve can be provided through which the coupling rod extends, whereby the immovable components relative to the first bearing block component such as, for example, the center reset mechanism or the vertical support engage with this guide sleeve.

In another embodiment of the central buffer coupling of the invention, in which the first bearing block component includes a bearing plate provided with an opening through which the coupling head-side end of the second bearing block component is at least partly guided upon an axial displacement of said second bearing block component effected by the linear drive, the present invention provides for the first bearing block component to exhibit a stop element adjoining the vehicle-side end face of the bearing plate and fixedly connected to the bearing plate, the deformable tube resting against the vehicle-side end of same, and a supporting element positioned at least partly within the deformable tube which is fixedly connected to the stop element, whereby the primary part of the linear drive is fixedly connected to the supporting element and thus, also to the first bearing block component. Of course, one of ordinary skill in the art would know that other embodiments are possible without departing from the spirit and the scope of the present invention.

Another embodiment of the linkage for the vehicle-side end of the coupling rod to the second bearing block component provides for the second bearing block component to exhibit a joint fork on its coupling head-side end which accommodates a joint eye configured on the vehicle-side end of the coupling rod and which is mounted by means of a joint pin so as to be horizontally pivotable. In this embodiment, the connection between the joint fork and the joint eye is realized by means of a spherical support bearing which, configured as a regenerative drawgear, contributes to the force-absorbing concept of the central buffer coupling and in particular at least partially cushions the tensile and compressive forces occurring during normal vehicle operation.

Additionally or alternatively to the spherical support bearing being provided in the connection between the coupling rod and the second bearing block component, the bearing can enable a cardanic motion of the coupling rod relative to the second bearing block component. It would be conceivable, for example, to configure the joint eye on the vehicle-side end of the coupling rod in respective correspondence hereto.

Additionally or alternatively to the drawgear provided in the linkage for the coupling rod to the second bearing block component, another embodiment of the central buffer coupling according to the invention provides for a regeneratively-configured drawgear in the coupling rod. Such drawgear(s) is/are configured so as to absorb tensile and compressive forces up to a defined magnitude and then relay any forces which exceed that to the bearing block. The shock absorber downstream from the bearing block with the destructively-configured force-absorbing member in the form of the deformable tube with its coupling head-side end against the bearing block and its vehicle-side end against the fixing plate thereby serves as the vehicle shock absorber, in particular, upon larger rear-end collision speeds (excessive impact). The combination of drawgear (cushioning unit) and the destructively-configured force-absorbing member enables not only the absorbing of tensile and compressive forces which occur during normal vehicle operation and are usually absorbed by the regeneratively-configured drawgear, but the deformable tube of the shock absorber also at least partly absorbs and thus, dissipates, the forces occurring upon the operating load of the drawgear being exceeded, the exceeding of the operating load of the central buffer coupling respectively, for instance, in the case of the vehicle impacting an obstacle or abruptly decelerating.

As regards the destructively-configured force-absorbing member (deformable tube) of the shock absorber, it is conceivable for this deformable tube to be designed such that upon a predefinable operating load of the central buffer coupling being exceeded, it is pushed by the bearing block, the first bearing block component respectively, at reduced diameter through the hole of the nozzle plate with simultaneous conversion of impact force into deformation work, while at the same time, the bearing block with the first and second bearing block component is moved in the direction of the fixing plate, whereby the fixing plate is configured here as a nozzle plate having a preferably centrally-arranged hole through which the deformable tube is pushed when the operating load of the central buffer coupling is exceeded.

It would however, also be alternatively conceivable here for the shock absorber to exhibit a conical ring against which the deformable tube abuts, whereby the deformable tube is designed so as to convert impact energy into deformation work at an extended diameter upon the exceeding of a predefinable operating load for the central buffer coupling, while at the same time the bearing block with the first and second bearing block component is moved in the direction of the moving plate. This embodiment would have the advantage that upon activation of the shock absorber, the plastically-deformed deformable tube is not expelled from the shock absorber but is instead held in the gap between the bearing plate and the fixing plate. In particular, no space hereby needs to be provided behind the shock absorber into which the plastically-deformed deformable tube would be thrust in the event of a crash.

In another embodiment of the linear drive, the axial displacement of the coupling rod is provided for by an electric linear motor, a hydraulic linear motor or a linear drive including a threaded spindle. A hydraulic linear motor (also known as a hydraulic cylinder) is characterized by its compact structuring, whereby its functional principle is based on converting energy from a hydraulic fluid supplied by a hydraulic accumulator or a hydraulic pump into a force acting in a simple, controllable straight line. An electric linear motor enables—in contrast to a rotary current motor, for example—a direct translatory motion which can be used to axially displace the coupling rod. Alternatively hereto, however, it is also conceivable to use a rotary current motor in combination with a threaded spindle, for example; this then serving to convert the rotary motion generated by the rotary current motor into a translatory motion so as to thereby enable an axial displacement of the coupling rod.

Regardless of the technical realization of the linear drive, according to the invention, the linear drive is externally controllable in order, for example, to extend the coupling rod with the coupling head into the coupling plane in preparation for a coupling procedure or to retract the extended coupling rod with the coupling head back into e.g., the nose cone of the vehicle after a decoupling procedure has been completed.

In order to achieve having the coupling rod being held in its extended state in the coupling-ready position and especially to achieve that the coupling rod remains fixed relative the first bearing block component even given transfer of high impact forces, a particularly preferred further development of the automatic central buffer coupling provides for same to further include a preferably mechanically or pneumatically actuatable locking which interacts on the one hand with the first bearing block component and, on the other, with the second bearing block component such that the second bearing block component can be locked to the first bearing block component after being axially displaced by means of the linear drive.

A preferred realization of the locking provides for the same to include a locking mechanism disposed on the first bearing block component and a stop member actuated by the locking mechanism likewise disposed on the first bearing block component, as well as at least one stop member configured complementary to the first stop member and arranged at a predefined position on the second bearing block component.

Both stop members are configured so as to engage upon actuation of the locking mechanism when the coupling rod is either in extended or retracted state. Of course, other locking mechanism embodiments are also conceivable.

As a basic principle, the coupling rod is obviously not limited to only being axially displaceable between the fully extended position and the fully retracted position. It would also be conceivable, for example, for the coupling rod to be axially displaced by means of the linear drive into any position desired relative the first bearing block component between the fully extended and the fully retracted position. It is also conceivable to provide corresponding locking mechanisms at any given position between the fully extended and the fully retracted position.

Lastly, with respect to the shock absorber, it is preferably provided that the same further includes a longitudinal displacement guide having at least one guide rail which is secured at its vehicle-side end to the fixing plate and configured so as to allow a controlled axial movement of the bearing block with the first and second bearing block component toward the fixing plate upon a predefined operating load of the central buffer coupling being exceeded. This type of longitudinal displacement guide enables the deformable tube to deform in a defined manner in the event of an impact such that the sequence of events involved in absorbing force is predefinable. The at least one guide rail of the longitudinal displacement guide moreover facilitates the assembly (installation) of the central buffer coupling in the vehicle's mounting space.

There has thus been outlined, some features consistent with the present invention in order that the detailed description thereof that follows may be better understood, and in order that the present contribution to the art may be better appreciated. There are, of course, additional features consistent with the present invention that will be described below and which will form the subject matter of the claims appended hereto.

In this respect, before explaining at least one embodiment consistent with the present invention in detail, it is to be understood that the invention is not limited in its application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

BRIEF DESCRIPTION OF THE DRAWINGS

The figures as herewith included will be used in the following to describe embodiments of the inventive central buffer coupling in greater detail. Note is to be made of the fact that the invention is not limited to the details as depicted in the figures.

DESCRIPTION OF THE INVENTION

Figure 1:
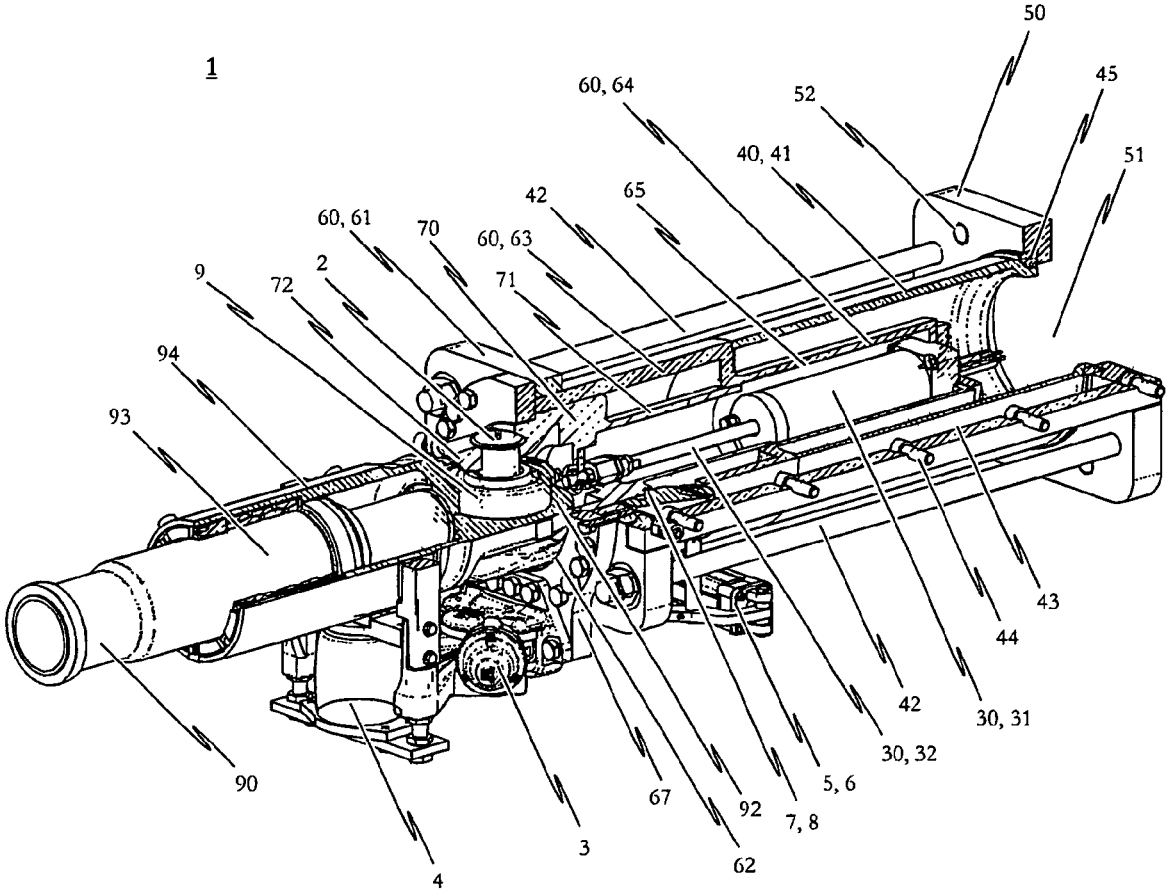
FIG. 1 depicts a perspective partly sectional view of the vehicle-side segment of the embodiment of the central buffer coupling according to the invention.
Figure 2:
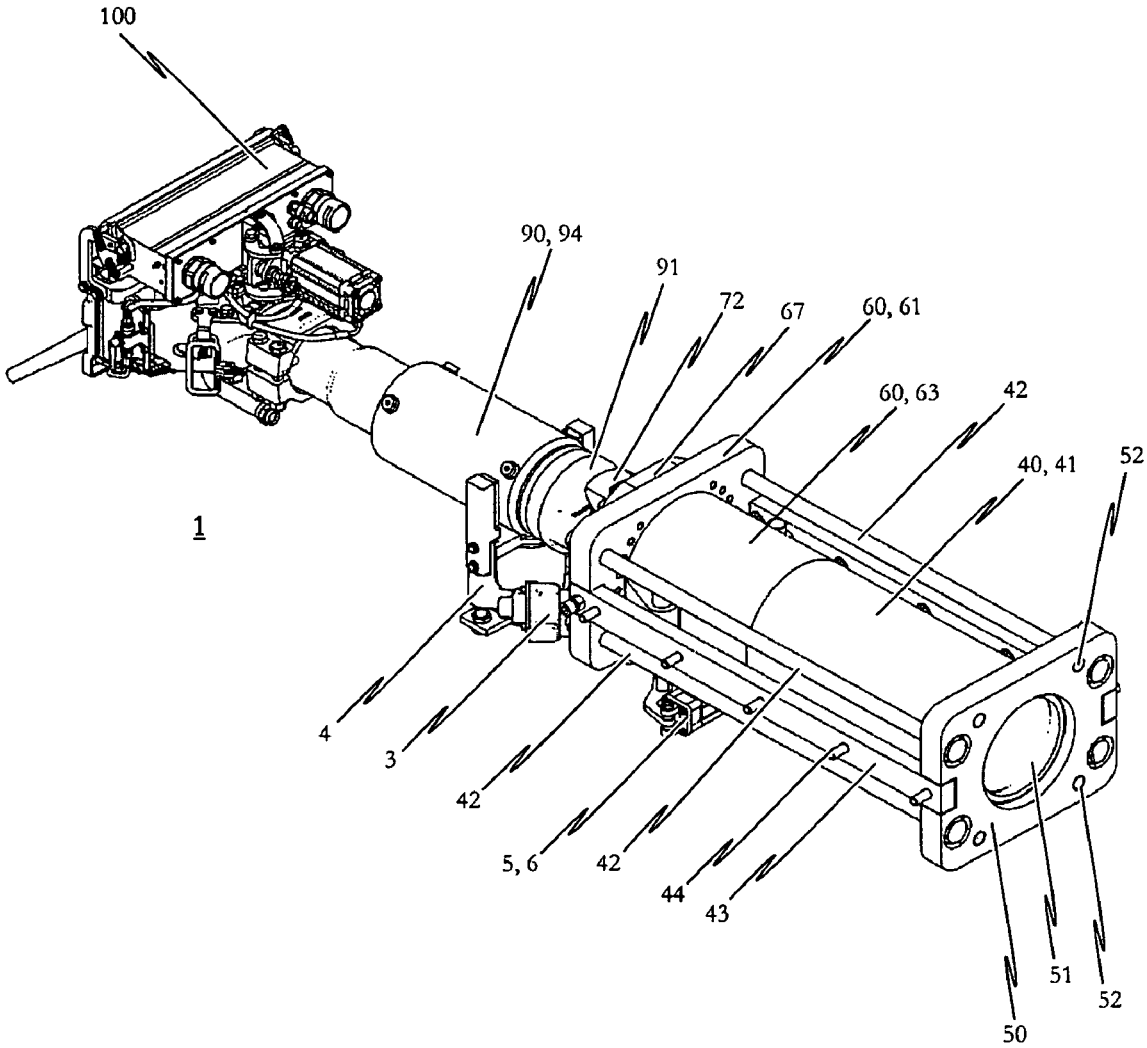
FIG. 2 is a perspective view of the entire central buffer coupling pursuant to FIG. 1
Figure 3:
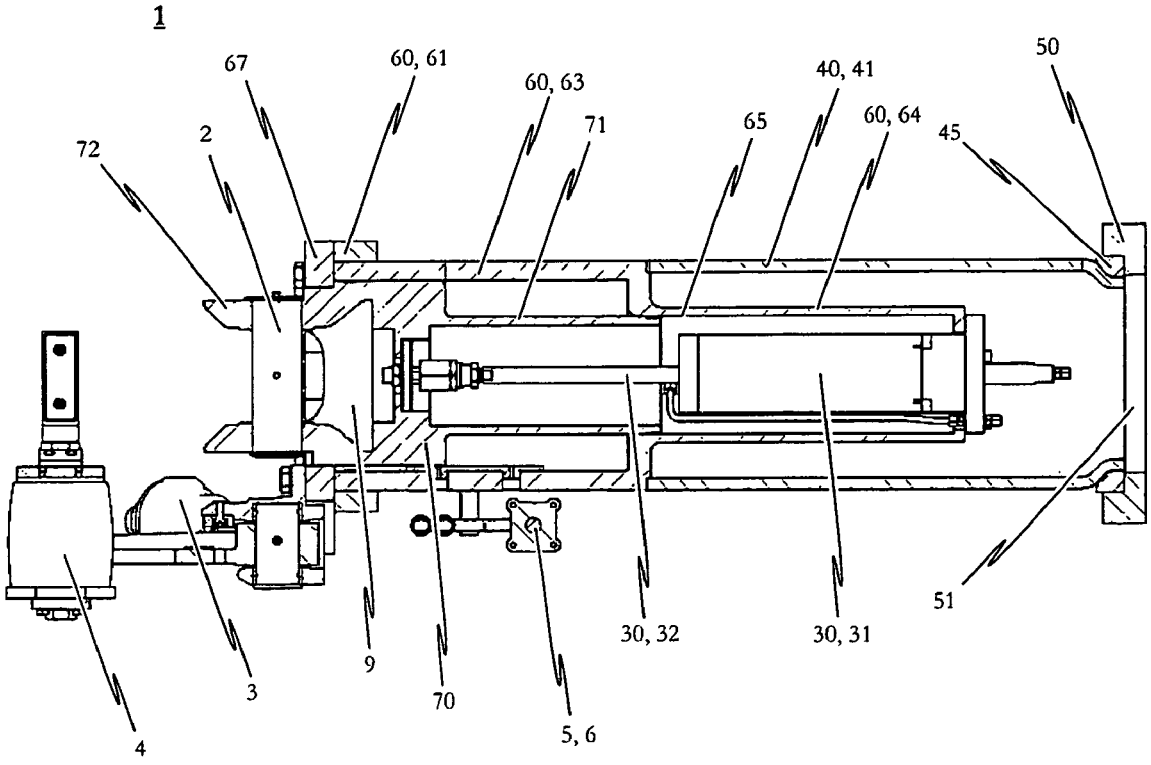
FIG. 3 is a partly sectional side view of the bearing block and shock absorber utilized in the central buffer coupling according to FIG. 1.
Figure 4:
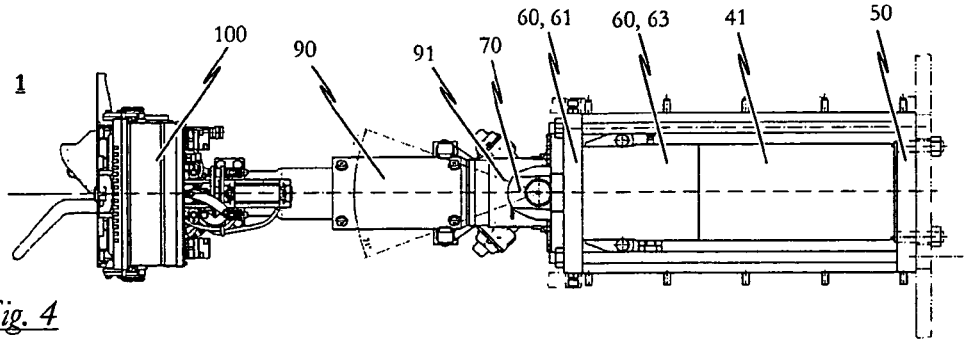
FIG. 4 is a top plan view of the entire central buffer coupling pursuant FIG. 1.

One embodiment of the inventive central buffer coupling will be described in the following with particular reference being made to FIGS. 1 to 4. The rear part of the central buffer coupling is thereby shown in FIG. 1 in a partly sectional perspective view. FIG. 2 shows a perspective view of the complete central buffer coupling in accordance with one embodiment while FIG. 3 depicts the bearing block and the shock absorber of one embodiment in a partly sectional side view. FIG. 4 shows a top plan view of the complete central buffer coupling according to one embodiment.

Figure 6:
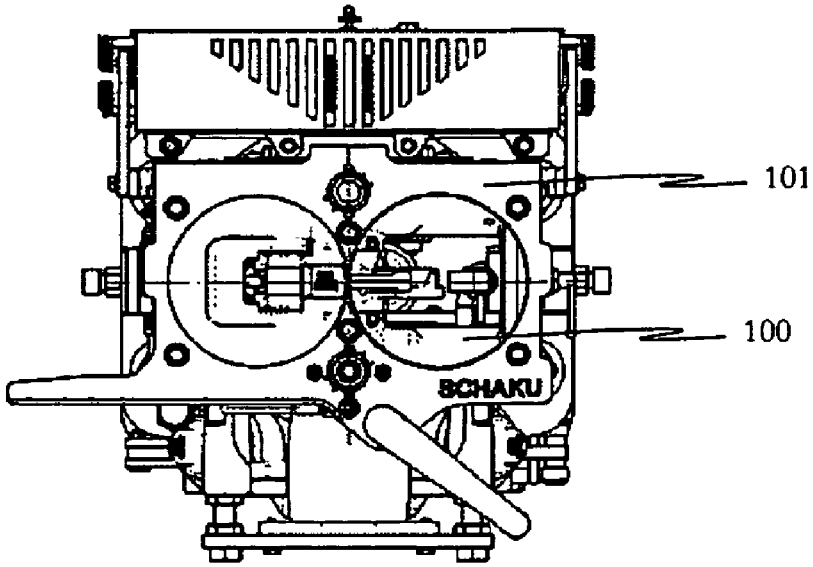
FIG. 6 is a top plan view of the coupling head of the central buffer coupling pursuant FIG. 1.

The automatic central buffer coupling 1, which is especially suited to a high-speed end car of a rail vehicle, includes a coupling head 100 which, for example, can be—as can be seen in particular in FIG. 6 of the attached drawings—a Type 10 Scharfenberg® coupling head. In FIG. 6, one embodiment of the inventive central buffer coupling is shown in a top plan view onto the end plate 101 of the coupling head 100.

That the coupling head 100 is connected to a coupling rod 90 can be seen especially from FIGS. 2 and 4. As shown by FIG. 1, for example, a regeneratively-configured drawgear 93 is integrated into coupling rod 90 in the form of a hydraulically-working cushioning unit. This drawgear 93 serves to absorb the tensile and compressive forces transferred during normal vehicle operation.

Further to be seen from FIG. 1 is that a joint eye 92 is configured on the vehicle-side end 91 of the coupling rod 90 which is received by a joint fork 72 of the bearing block 60, 70 and which is mounted by means of a joint pin 2 so as to be horizontally pivotable. The bearing of the joint eye 92 thereby ensues preferably by means of a spherical support bearing 9, which, additionally to the drawgear 93 of the coupling rod 90, cushions forces occurring during normal vehicle operation.

Figure 5A:
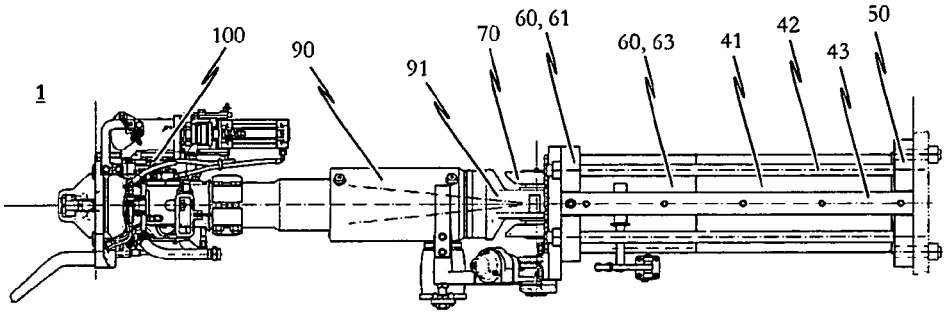
FIG. 5*a* is a side view of the central buffer coupling according to FIG. 4 in a fully extended state.

FIGS. 4 and 5*a* show that the coupling rod 90 is not only pivotable in a horizontal plane, but also a certain vertical pivoting range.

The automatic central buffer coupling 1 according to the present invention is fixed to the underframe of the not explicitly shown vehicle—to the end face of the vehicle respectively, by means of a fixing plate 50. The corresponding holes 52 to receive the appropriate bolts, etc., are hereby provided in fixing plate 50.

So that the central buffer coupling 1 according to the invention exhibits the most optimum crash performance characteristics as possible, a shock absorber 40 with a destructively-configured force-absorbing member in the form of a deformable tube 41 is provided between the bearing block 60, 70 and the fixing plate 50 with its coupling head-side end adjoining the bearing block 60, 70 and its vehicle-side end adjoining the fixing plate 50. The shock absorber 40 further includes a bolted connection 42 axially bracing the bearing block 60, 70, the deformable tube 41 and the fixing plate 50 and allowing an axial displacement of the bearing block 60, 70 relative to the fixing plate 50, upon excessive impact.

So that the coupling rod 90 can be axially displaced relative to the fixing plate 50 in order to thus, enable extension and retraction of the coupling head 100, the central buffer coupling 1 furthermore includes a linear drive 30 arranged within the deformable tube 41. The bearing block 60, 70 is moreover, of two-piece configuration, whereby the coupling head-side end of the deformable tube 41 adjoins a first bearing block component 60, and whereby the vehicle-side end 91 of the coupling rod 90 is articulated to a second bearing block component 70. The linear drive 30 thus provided in the shock absorber 40, is configured so as to axially displace the second bearing block component 70 relative to the first bearing block component 60.

Specifically, the linear drive 30 includes a primary part 31 coupled with the first bearing block component 60 and a secondary part 32 coupled with the second bearing block component 70, whereby upon actuation of the linear drive 30, the primary part 31 and the secondary part 32 of the linear drive 30 are movable relative one another in a telescopic sequence of motion in which the primary part 31 and the secondary part 32 of the linear drive 30 axially displace into one another.

The translational movement transferred from the secondary part 32 of the linear drive 30 to the second bearing block component 70 is transferred directly from the second bearing block component 70 to the coupling rod 90 since the joint eye 92 provided on the vehicle-side end 91 of the coupling rod 90 is coupled with the joint fork 72 configured on the coupling head-side end of the second bearing block component 70.

As can especially be seen in FIGS. 1 and 3, the first bearing block component 60 includes a bearing plate 61 in which an opening 62 is provided, through which the coupling head-side end of the second bearing block component 70 together with the coupling rod 90 articulated thereto, is at least partly guided upon an axial displacement actuated by the linear drive 30. A support plate 67 is furthermore releasably affixed to the coupling head-side end face of the bearing plate 61. In one embodiment, this support plate 67 serves to hold a center reset mechanism 3 as well as a vertical support 4. Neither the center reset mechanism 3 nor the vertical support 4 engage directly with the coupling rod 90 but rather with a guide sleeve 94 through which the coupling rod 90 extends. As with the coupling rod 90, the guide sleeve 94 is displaced relative the support plate 67 and thus relative the center reset mechanism 3 and the vertical support 4 upon actuation of the linear drive 30.

In addition to the bearing plate 61 mentioned above, the first bearing block component 60 moreover, includes a stop element 63 fixedly connected to the bearing plate 61, against the vehicle-side end of which the deformable tube 41 abuts. Additionally hereto, the first bearing block component 60 includes a supporting element 64 extending into the interior of the deformable tube 41 which is fixedly connected to the stop element 63 of the first bearing block component 60. This supporting element 64 serves to hold the stationary primary part 31 of the linear drive 30 with respect to the fixing plate 50 upon actuation of the linear drive 30. In the embodiment as depicted, the stop element 63 and the supporting element 64 of the first bearing block component 60 are of one-piece configuration in order to ensure the lowest manufacturing and assembly costs possible.

The second bearing block component 70, which is axially displaceable relative to the first bearing block component 60 by means of the secondary part 32 upon activation of the linear drive 30, includes a linear guide 71 extending axially in the vehicle direction, which upon actuation of linear drive 30, enables the moving secondary part 32 of the linear drive 30 relative the primary part 31 of said linear drive 30 on an axially-extending surface 65.

In one embodiment of the central buffer coupling 1, the fixing plate 50 is configured as a nozzle plate having a centrally-arranged hole 51, whereby the shock absorber 40 further includes a conical ring 45 against which abuts the nozzle-side end of the deformable tube 41. The deformable tube 41 of the shock absorber 40 is designed to be pressed at reduced diameter, through the hole 51 of the nozzle plate 50 by the stop element 63 of the first bearing block component, upon a predefined operating load of the central buffer coupling 1 being exceeded with simultaneous conversion of impact force into deformation work. At the same time as this energy is being dissipated, the bearing block with the first and the second bearing block component 60, 70 is moved toward the fixing plate 50.

The shock absorber 40 furthermore includes a longitudinal displacement guide having two guide rails 43 which are fixed to the fixing plate 50 by their vehicle-side ends and configured so as to allow a controlled axial movement of the entire bearing block including the first bearing block component 60 and the second bearing block component 70 upon an excessive impact. These guide rails 43 however additionally serve to facilitate the fitting of the automatic central buffer coupling into the mounting space of the vehicle. The guide rails 43 are thereby affixed to the corresponding walls of the installation space by means of bolts 44.

The inventive central buffer coupling further exhibits a mechanically or pneumatically operable lock 5 including a locking mechanism 6 which interacts with a first locking member 7 arranged on the first bearing block component 60. A second locking member 8 correspondingly complementary to the first locking member 7 is arranged on the second bearing block component 70 which can engage with the first locking member and thus, ensure a locking of the second bearing block component 70 relative to the first bearing block component 60. Depending upon the position of the second locking member 8 on the second bearing block component 70, the second bearing block component 70 can thus be locked at different positions.

The extendability and retractability function to the coupling rod 90 as provided by the inventive central buffer coupling 1 will be described in the following with reference made to FIGS. 5*a* to 5*c*. FIG. 5*a*, shows a side view of one embodiment of the central buffer coupling in an extended state; i.e., in a state in which the coupling rod 90 and the second bearing block component 70 are in their extended position by means of the linear drive 30. In this state, the coupling head 100 lies in the coupling plane and is thus, in a coupling-ready state.

Figure 5B:
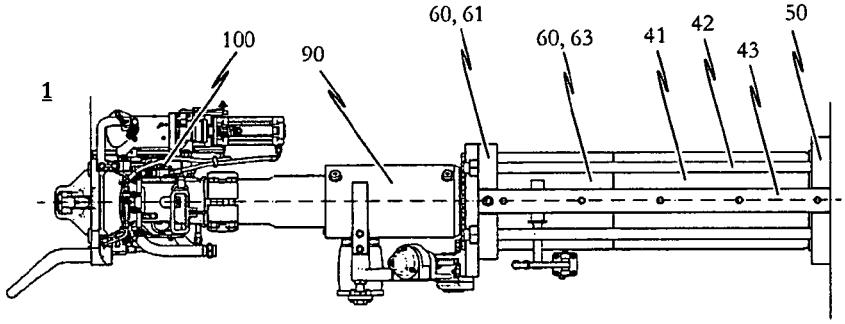
FIG. 5*b* is a side view of the central buffer coupling according to FIG. 5*a* in a fully retracted state.

FIG. 5*b* shows a state in which the second bearing block component 70 is axially displaced relative to the first bearing block component 60 toward the fixing plate 50 by means of the linear drive 30. As shown, the coupling head-side section of the second bearing block component 70 together with the joint pin 2, the joint fork 72, the joint eye 92 and the vehicle-side end 91 of the coupling rod 90, are led through the opening 62 provided in the bearing plate 61 of the first bearing block component 60. In contrast to the position as shown in FIG. 5*a*, the coupling head 100 is thus no longer within the coupling plane, but instead in a retracted plane such that, for example, a (not shown) front hatch of the vehicle can be closed in order to thus ensure a closed nose cone.

Figure 5C:
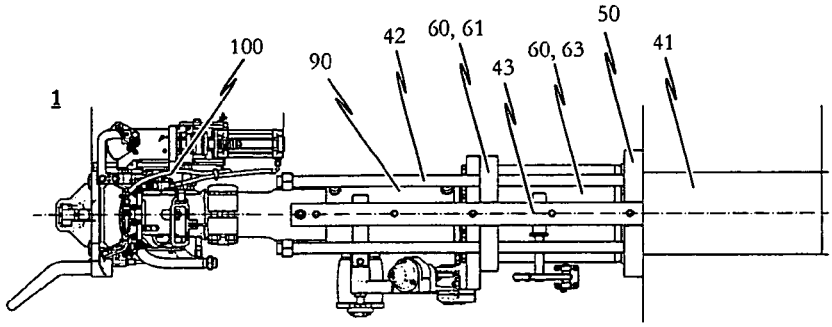
FIG. 5*c* is a side view of the central buffer coupling according to FIG. 5*b* subsequent to shock absorber activation.

FIG. 5*c* shows the central buffer coupling 1 as depicted in FIG. 5*b* subsequent to activation of the shock absorber. As shown, the entire bearing block, including the first bearing block component 60 and the second bearing block component 70, is axially moved toward the fixing plate 50 upon activation of the shock absorber, whereby this movement is controlled in the axial direction by the guide rails 43 and the bolted connection 42. Upon the movement of the bearing block 60, 70 toward the fixing plate 50, the deformable tube 41 is pressed at reduced diameter through the hole 51 provided in the fixing plate 50, whereby at least a portion of the transferred impact force is at the same time converted into deformation work and thus, dissipated. To be noted in conjunction hereto is that the first bearing block component 60 and the second bearing block component 70 are moved toward the fixing plate 50 together with linear drive 30 as one unit.

Figure 7:
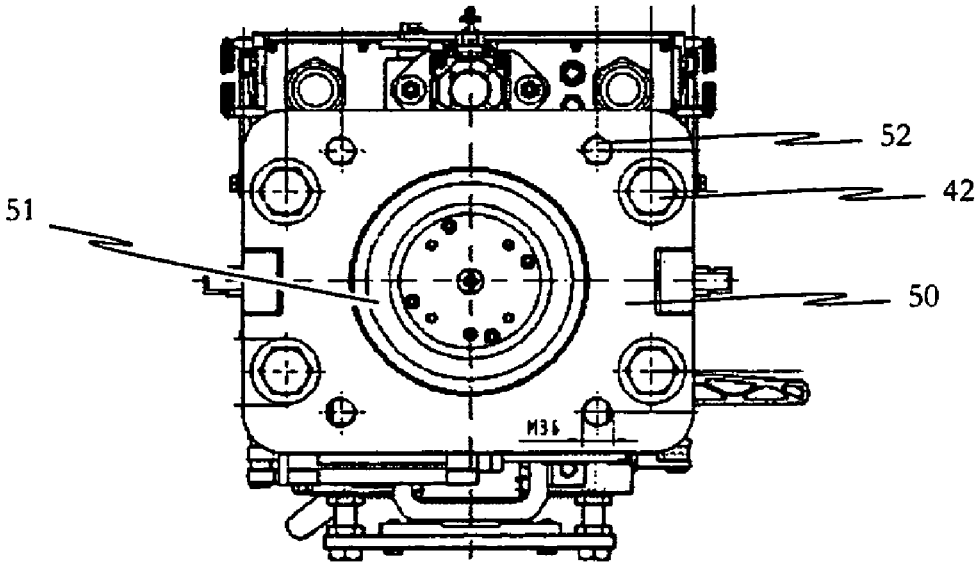
FIG. 7 is a top plan view of the fixing plate of the central buffer coupling pursuant FIG. 1.

FIG. 7 shows a top plan view of the central buffer coupling according to the preferred embodiment onto the fixing plate 50 configured as a nozzle plate.

Explicit reference is made to the fact that the present invention is not limited to the details as depicted in the figures. It is thus for example conceivable to use an electric linear motor instead of a hydraulically-working linear motor.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

The invention claimed is:

1. An automatic central buffer coupling for a rail-mounted vehicle comprising:

a coupling head;

a coupling rod connected to the coupling head;

a bearing block to which the vehicle-side end of the coupling rod is articulated so as to be horizontally pivotable;

a fixing plate attachable to an underframe of the vehicle to secure the central buffer coupling to the vehicle; and a shock absorber comprising a destructively-configured force-absorbing member in a form of a deformable tube with its coupling head-side end against the bearing block and its vehicle-side end against the fixing plate;

wherein the shock absorber comprises a bolted connection which axially braces the bearing block, the deformable tube and the fixing plate, and which allows an axial displacement of the bearing block relative to the fixing plate upon excessive impact;

wherein the automatic central buffer coupling further comprises a controllable linear drive for the axial displacement of the coupling rod relative to the fixing plate, the linear drive being disposed within the deformable tube, and the bearing block comprises a first bearing block component against which adjoins the coupling head-side end of the deformable tube and a second bearing block component to which the vehicle-side end of the coupling rod is articulated;

wherein the second bearing block component is axially displaceable relative to the first bearing block component by the linear drive.

2. The central buffer coupling according to claim 1, wherein the linear drive comprises a primary part coupled with the first bearing block component and a secondary part coupled with the second bearing block component; and wherein upon actuation of the linear drive, the primary part and the secondary part of the linear drive are movable relative to one another in a telescopic sequence of motion in which the primary part and the secondary part of the linear drive axially displace into one another.

3. The central buffer coupling according to claim 2, wherein the first bearing block component comprises a bearing plate in which an opening is provided through which the coupling head-side end of the second bearing block component is at least partly guided upon an axial displacement of the second bearing block component effected by the linear drive; and wherein the first bearing block component exhibits a stop element adjoining the vehicle-side end face of the bearing plate and fixedly connected to said bearing plate with the deformable tube resting against its vehicle-side end, and a supporting element positioned at least partly within the deformable tube which is fixedly connected to the stop element; and wherein the primary part of the linear drive is fixedly connected to the supporting element.

4. The central buffer coupling according to claim 3, wherein the second bearing block component comprises at least one linear guide extending axially in the vehicle direction which slides on an axially-extending surface of the supporting element upon actuation of linear drive and which provides an axial guiding of the moving secondary part relative to the primary part of the linear drive.

5. The central buffer coupling according to claim 1, whereby the second bearing block component comprises a joint fork on its coupling head-side end which accommodates a joint eye configured on the vehicle-side end of the coupling rod and which is mounted by means of a joint pin so as to be horizontally pivotable.

6. The central buffer coupling according to claim 1, wherein the first bearing block component comprises a bearing plate in which an opening is provided through which the coupling head-side end of the second bearing block component is at least partly guided upon an axial displacement of the second bearing block component effected by the linear drive.

7. The central buffer coupling according to claim 1, wherein the fixing plate is configured as a nozzle plate having a preferably centrally-arranged hole, and whereby the deformable tube is configured so as to be pressed by the first bearing block component at reduced diameter through the hole of the nozzle plate with simultaneous conversion of impact force into deformation work upon exceeding of a predefinable operating load for the central buffer coupling while the bearing block with the first and second bearing block component is simultaneously moved in the direction of the fixing plate.

8. The central buffer coupling according to claim 1, wherein the shock absorber exhibits a conical ring against which abuts the coupling head-side end of the deformable tube; and wherein the deformable tube is designed so as to convert impact energy into deformation work at an extended diameter upon exceeding of a predefinable operating load for the central buffer coupling while the bearing block with the first and second bearing block component is simultaneously moved in the direction of the fixing plate.

9. The central buffer coupling according to claim 6, wherein the central buffer coupling further comprises a releasable support plate on the coupling head-side end face of the bearing plate for securing a center reset mechanism and/or a vertical support for the coupling rod.

10. The central buffer coupling according to claim 1, wherein the linear drive is one of an electric linear motor, a hydraulic linear motor or a linear drive comprising a threaded spindle.

11. The central buffer coupling according to claim 1, wherein a preferably regeneratively-configured drawgear is provided in the coupling rod and/or in the linkage of the coupling rod to the second bearing block component.

12. The central buffer coupling according to claim 1, wherein the central buffer coupling further comprises a mechanically actuatable lock which interacts with one of the first bearing block component and, with the second bearing block component such that the second bearing block component can be locked to the first bearing block component after being axially displaced by means of the linear drive.

13. The central buffer coupling according to claim 12, wherein the lock comprises a locking mechanism disposed on the first bearing block component and a stop member actuatable by the locking mechanism arranged on said first bearing block component, and at least one stop member configured complementary to said first stop member, and arranged at a predefined position on the second bearing block component.

14. The central buffer coupling according to claim 1, wherein the shock absorber further comprises a longitudinal displacement guide having at least one guide rail which is secured at its vehicle-side end to the fixing plate, and configured to allow a controlled axial movement of the bearing block with the first and second bearing block component toward the fixing plate upon a predefined operating load of the central buffer coupling being exceeded.

* * * * *